US005954116A

United States Patent [19]

Jung

[11] Patent Number: 5,954,116

[45] Date of Patent: Sep. 21, 1999

[54] SHOT SLEEVE AND SHOT UNIT FOR A DIE CASTING MACHINE

[75] Inventor: Paul Jung, Niederuzwil, Switzerland

[73] Assignee: Buhler AG, Uzwil, Switzerland

[21] Appl. No.: 08/916,222

[22] Filed: Aug. 22, 1997

[51] Int. Cl.[6] ..... B22D 17/04; B22D 17/00

[52] U.S. Cl. ..... 164/312; 164/134; 164/113

[58] Field of Search ..... 164/113, 312, 164/134

[56] References Cited

U.S. PATENT DOCUMENTS

| | | | |
|---|---|---|---|
| 2,932,865 | 4/1960 | Bauer . | |
| 3,270,383 | 9/1966 | Hall et al. . | |
| 3,528,478 | 9/1970 | Koch et al. . | |
| 4,144,734 | 3/1979 | Ishiba | 72/253 |
| 4,664,173 | 5/1987 | Wolnaiak | 164/113 |
| 4,667,729 | 5/1987 | Zecman | 164/312 |
| 4,687,042 | 8/1987 | Young | 164/80 |
| 5,575,325 | 11/1996 | Sugiura et al. | 164/120 |
| 5,630,463 | 5/1997 | Shimmell | 164/312 |
| 5,730,201 | 3/1998 | Rollin et al. | 164/113 |

FOREIGN PATENT DOCUMENTS

| | | |
|---|---|---|
| 0 710 515 | 5/1996 | European Pat. Off. . |
| 0 718 059 | 6/1996 | European Pat. Off. . |
| 640842 | 7/1928 | France . |
| 921881 | 12/1954 | Germany . |
| 195 07 995 | 12/1995 | Germany . |
| 19507995 | 12/1995 | Germany . |
| 56-5621 | 2/1981 | Japan . |
| 59-141358 | 8/1984 | Japan . |
| 1-162555 | 6/1989 | Japan . |
| 2 056 338 | 3/1981 | United Kingdom . |
| WO80/01656 | 8/1980 | WIPO . |

*Primary Examiner*—Patrick Ryan
*Assistant Examiner*—Anjan Dey
*Attorney, Agent, or Firm*—Burns, Doane, Swecker & Mathis, LLP

[57] ABSTRACT

A shot sleeve for a die casting machine includes an elongated hollow body for receiving and guiding a shot plunger. This body defines an elongated chamber of predetermined cross-section having a front opening leading to a sprue runner of a die. The cross-section enlarges over part of its length towards the front opening. The plunger's front surface can include a conical surface which tapers away from a perimetrical scraping edge of the plunger, the conical surface having an axial end surface of smaller cross-section than the perimetrical edge. The arrangement allows undesirable material such as scrape peripheral portions of a slug of semi-solid metal to be trapped in a biscuit which remains in the shot sleeve after formation of a part.

36 Claims, 3 Drawing Sheets

SHOT SLEEVE AND SHOT UNIT FOR A DIE CASTING MACHINE

FIELD OF THE INVENTION

The invention relates to a shot sleeve and a shot unit for a die casting machine, such as a cold chamber die casting machine having a horizontal cold chamber or shot sleeve.

BACKGROUND OF THE INVENTION

U.S. Pat. No. 4,687,042 states that a shell of a semi-solid slug can be prevented from entering a die cavity by placing the slug in a prechamber of a vertical forging machine and causing a portion of the slug to pass through a coaxial reduced diameter gate, thereby retaining the shell in the prechamber. However, where the shell has been globularized by heating the semi-solid slug, peripheral, globularized portions of the slug are not necessarily prevented from entering the die cavity, and undesired portions of the slug such as surface oxides and other surface impurities of the heated slug can be swept into the die cavity. The present invention is therefore directed to addressing flow control of metal, such as liquid or semi-solid metal, into a part forming die.

Although plungers of die casting machines generally have substantially planar tips which fill uniform diameter shot chambers, plungers with modified tip arrangements or modified shot sleeves are disclosed in U.S. Pat. Nos. 2,932,865 and 3,528,478, Japanese Patent Publication No. 56-5621, French Patent No. 640,842 and German Patent No. 921,881. U.S. Pat. No. 4,144,734 discloses an extrusion plunger having an annular step for collecting impurities. German Patent Application No. DE-19507995-A1 discloses a die casting arrangement wherein a radially enlarged space is provided at the end of the shot sleeve to trap undesirable material. Despite the existence of these known modifications to plungers and shot sleeves, it would be desirable to optimize flow control and retention of undesired surface portions of metal placed into a shot sleeve during a die filling process using, for example, liquid metal or semi-solid metal which has been heated to globularize any dendritic shell.

SUMMARY OF THE INVENTION

It is therefore an object of the invention to improve flow control and to prevent undesired portions of metal being processed, such as surface impurities in the form of particles, from reaching the die cavity.

This is achieved according to an exemplary embodiment of the invention by providing a shot sleeve whose inner cross-section enlarges over part of its length towards a front opening that faces a sprue runner of a die. The surprising action of such an arrangement is based on the finding that most plungers scrape undesired portions of metal in the shot sleeve, such as peripheral metal that might be present in a shot sleeve, off the inner walls of the latter, wherein the perimetrical front edge (the "peripheral" if the plunger is more or less cylindrical, as usual, and does not have a polygonal cross-section) of the plunger acts as a scraper edge. However, the present inventor has found that with scraping the inner wall, the problem arises as to where to dispose of the scraped peripheral portion. Even if a ring of relatively short axial length (such as a concentric ring having a diameter which exceeds that of the slot sleeve) is used to retain the peripheral metal, it cannot be ensured that all of the scraped peripheral portion enters just that narrow gap in a radial outwards direction and does not move radially inwards. Moreover, since scraping is a "dynamic" operation, the metal becomes thicker and thicker the more the plunger moves towards the front opening, and there is the potential for build-up of the peripheral portion to the point where part of it enters the runner and possibly the die cavity. According to the invention, with an enlarging (e.g., stepped, conical, etc.) cross-section of the shot sleeve, the plunger can be prevented from scraping the peripheral portion of metal located on an interior of the shot sleeve. Instead, a space is provided between the outer surface of the plunger and the shot sleeve to inhibit a flow of metal from a peripheral region of the shot sleeve and into the die cavity. A further advantage of the invention is that the enlarged cross-section can provide a conical biscuit after the shot which is easier to push out, thus saving energy.

The present invention, according to a second exemplary aspect, also concerns a whole shot unit, i.e., a unit which comprises not only the shot sleeve, but also the shot plunger and its drive, and, optionally, an adjacent parts towards and before the cavity, such as those surfaces which define the sprue runner.

It has also been found that a synergistic effect can be achieved if the plunger's front surface comprises a conical surface tapering away from the plunger's perimetrical scraping edge, the conical surface having a base of smaller cross-section than the perimetrical edge to form a marginal surface under an angle to said conical surface. In this way, the tapering front cone acts like the tip of an arrow or like a plough, urging the peripheral portion of metal in the shot sleeve into the increasingly enlarging lateral space of the shot chamber. Such a synergistic effect cannot be achieved with a mere uniform diameter cylindrical shot chamber.

Moreover, the sprue runner can extend substantially in alignment with the direction of displacement of the shot plunger. This has the double effect of improving uniformity of shear and of improving the flow of semi-solid (e.g., thixotropic) metal, which becomes less viscous and more like a liquid only under shearing stress. This uniform application of shear is particularly enhanced if the sprue runner extends substantially in alignment with the longitudinal axis of the shot chamber, i.e., is centrally arranged with respect to the longitudinal axis rather than eccentrically.

In one embodiment, the walls or surfaces which define the sprue runner form a hollow conical surface which increases in diameter in a direction toward the interior of the shot chamber to enhance flow of liquid or semi-solid metal away from the runner. Such an embodiment can be varied in that this hollow cone can be matched to the shape of the conical front surface of the plunger. This results in a double effect: the interengaging cones form a valve-like closure member which establishes a further means to prevent surface oxides and other surface impurities in the scraped peripheral portion from flowing into the runner system. As another effect, the resulting biscuit can be smaller than usual, thus diminishing losses in the form of scrap metal.

Since the effect of configurations according to exemplary embodiments of the invention is the accommodation of impurities, such as oxides, or of pre-solidified metal, there is, according to a third aspect of the present invention, a process where the axial length of the enlargement of the chamber of the shot sleeve is chosen as a function of the axial length of a slug to be shaped in a die casting machine, as will become apparent from the following description.

BRIEF DESCRIPTION OF THE DRAWINGS

Further details will become apparent from the following description of exemplary embodiments schematically illustrated in the drawings, in which.

DETAILED DESCRIPTION OF THE PREFERRED EMBODIMENTS

Figure 1:
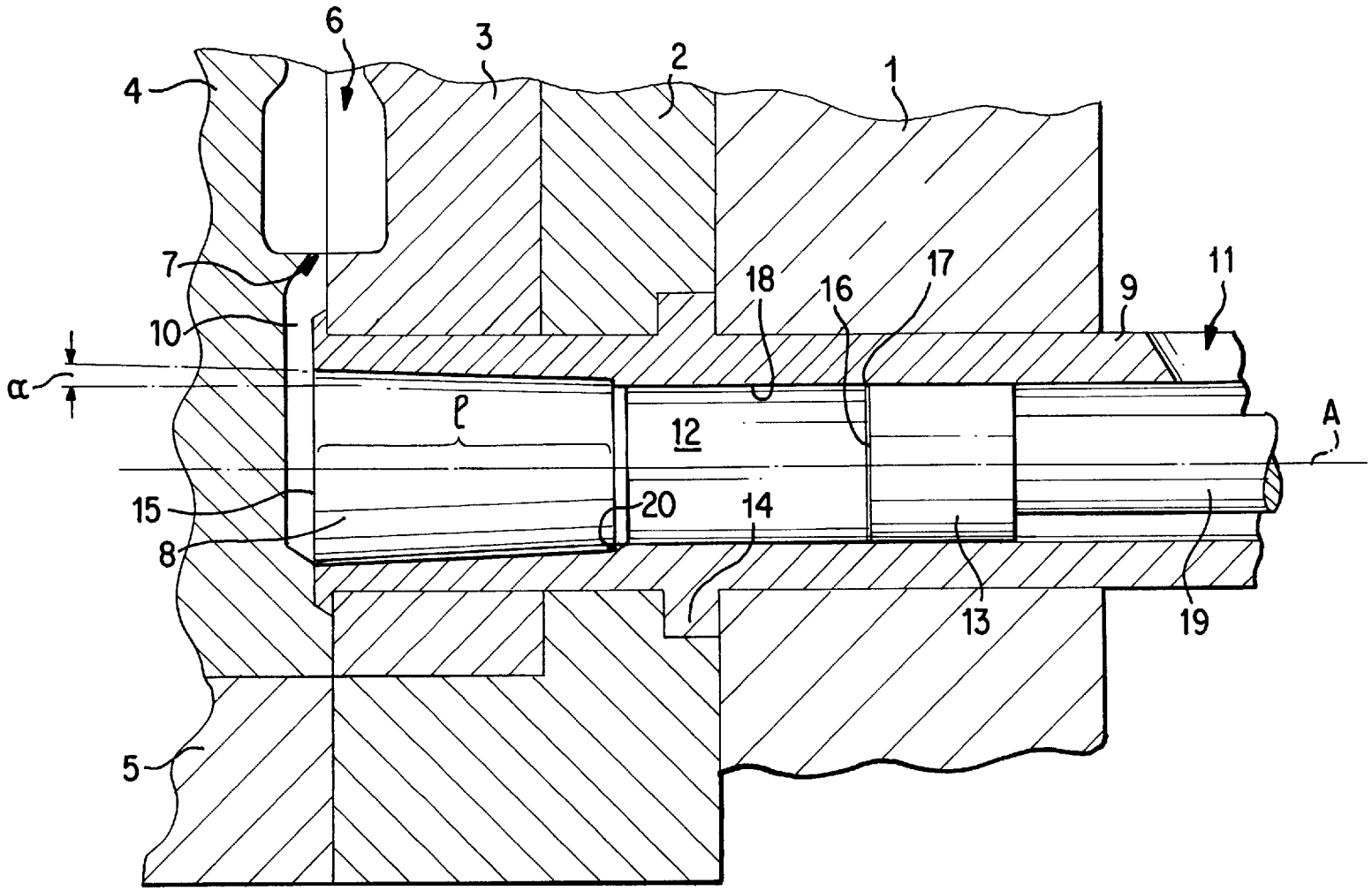
FIGS. 1–3 represent three different embodiments according to the invention in three different positions of the plungers in a longitudinal cross-section through the respective shot sleeves.

A conventional die casting machine, only part of which is shown in FIG. 1, comprises a stationary die mounting platen 1 onto which a stationary die 2 is mounted in a conventional manner which need not be shown in detail. The stationary die 2 has an insert 3 that, together with an insert 4 of a movable die 5 defines a cavity 6 only part of which is shown in FIG. 1. This cavity 6 is to receive metal in a liquid or semi-solid state that enters through a gate 7 of restricted cross-section which is in communication with a chamber 8 of a shot sleeve 9 through a sprue runner 10 and a front opening 15 of the chamber 8.

The shot sleeve 9 has an elongated opening 11 through which metal (e.g., a semi-solid slug 12) may be inserted when a shot plunger 13 is in a retracted position at the right side of FIG. 1 beyond opening 11. The shot sleeve has, moreover, a projection or flange 14 for fastening it to the platen 1 before the stationary die 2 is mounted on the platen. In this way, the shot sleeve 9 is clamped in a conventional manner between the parts 1 and 2. The cross-section of the chamber 8 can be circular, but other cross-sections, such as polygonal ones or other configurations known in the art can also be used.

The plunger 13 has a front surface 16 surrounded by a perimetrical or peripheral edge 17 that forms an angle of 90° with respect to a longitudinal axis A of the chamber 8 and the inner wall 18 thereof. In this way, the edge 17 will act as a scraper when metal freezes along this inner wall 18. This applies also if liquid metal is filled into the chamber 8 through the opening 11 and freezes at the bottom of the chamber 8. The plunger 13 is displaced via a plunger rod 19 that is connected to a conventional hydraulic drive which is not shown.

The present inventor has thus considered that the marginal or perimetrical edge 17 scrapes off peripheral portions formed on the outside of the metal (e.g., peripheral oxides), and that this peripheral portion should be prevented from entering the cavity 6 so as not to deteriorate the mechanical properties of the part to be formed. The more the plunger 13 moves towards the front opening 15, the larger the peripheral portion scraped off of inner wall 18 and, thus, the greater the probability that peripheral impurities will flow into the cavity. On the other hand, it will be clear that, when processing a slug, the slug is displaced towards the front opening 15 and engages the opposite wall of the insert 4 and sprue runner 10, where it will be subjected to shearing forces which convert the solid state of the slug 12 into more of a liquid-like state to create enhanced flow into cavity 6 while the edge 17, at the same time, continues to scrape off portions of the peripheral surface of the slug 12.

According to the present invention, a surface impurity accommodating space is therefore provided in that the cross-section of the chamber 8 enlarges more and more over a portion $\ell$ of its length in a direction towards the front opening 15. Thus, as an undesired portion of metal included in the shot sleeve is accumulated, more space is provided to accommodate it. The enlargement is shown, in principle, in a linear, tapering way, but could comprise at least one step, particularly an initial step 20 starting from the minimum cross-section before the enlargement of the chamber 8 begins. Just an initial step 20 enhances doubling of an ability to accumulate any undesired portion that might be present on the metal, while avoiding any squeezing effect due to a wedge-like configuration between the peripheral surface of the plunger 13 and the enlarging portion of the chamber 8. Furthermore, the tapering angle of the enlarged space can be chosen according to the axial length of the slug, the thickness of the undesired portion (e.g., oxide skin thickness), the type of metal used, etc. It has been found, however, that this angle $\alpha$, in practice, is preferably in a range of 3 to 20° at least over part of its axial length. The most preferred tapering angle is about 10°±5°.

Figure 2:
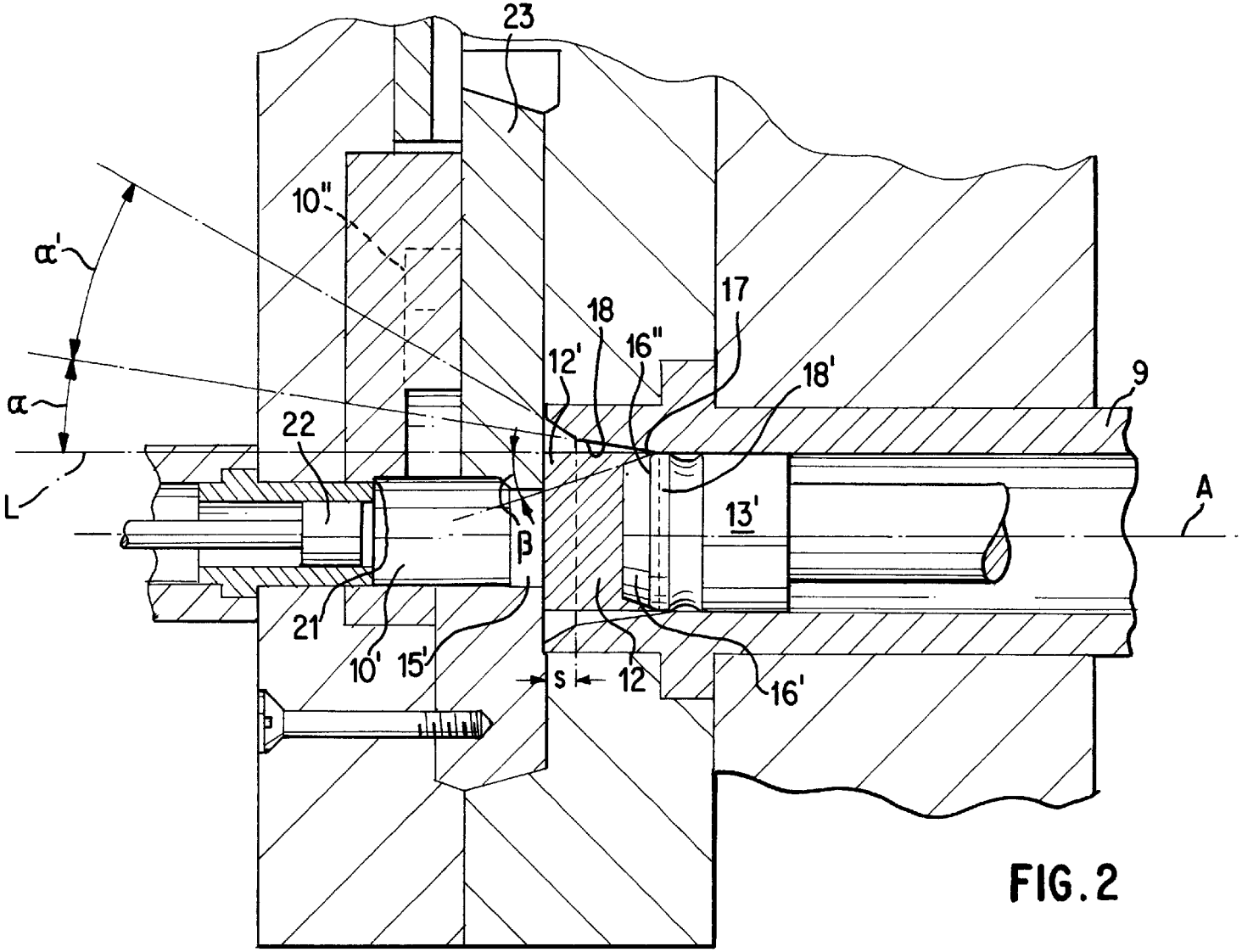

FIG. 2 shows a more advanced condition of a modified plunger 13' in a modified front opening and sprue runner system. In this condition, the plunger 13' presses against the metal (e.g., the end of a slug 12) to press it through a restricted front opening 15' which, preferably, is aligned with the longitudinal axis A, but could, in principle, be also eccentrical relative to this axis A.

The plunger 13' has a front surface 16' which forms a conical surface and tapers away from the perimetrical scraping edge 17 under a second tapering angle $\beta$ which has, preferably, the same magnitude as the tapering angle $\alpha$ or is, at least, in the same range.

As may be seen from FIG. 2, the conical front surface 16' has a smaller cross-section or diameter than the perimetrical edge 17. Therefore, a marginal surface 16" is formed that is at an angle to the conical surface 16'. This configuration has a certain synergistic effect together with the enlarging cross-section of the shot sleeve 9 in that the marginal surface 16" enhances doubling over of any peripheral portion 12' of the slug 12' while at the same time, the enlarging inner wall provides a space so that doubling is effected in a direction toward the radial outside rather than to the inside, as might be the case using a conical surface 16' without the enlarged inner wall 18. To the contrary, the conical surface 16' acts like a plough urging the peripheral portion towards the enlarged inner wall 18.

It should be noted that the plunger 13' can have a marginal edge which joins the conical surface 16' by a rounding 18', as indicated by interrupted lines, and which forms preferably a peripheral groove (also indicated by interrupted lines). In this way, the outer edge 17 (or its tangent to the rounding) will form a tip, when seen in cross-section, which improves control of flow from a periphery of the metal slug away from the axis A. This is particularly advantageous, because it promotes the tendency of undesired peripheral portions to be displaced into the radial outer space provided by the enlargement of the chamber within the shot sleeve 9.

Nevertheless, the more the plunger 13 approaches the front opening 15', the less predictable is the shape of the peripheral portion. Therefore, it is advantageous, if the cross-section of the chamber enlarges to a greater extent in a section "s" adjacent the front opening 15'. In FIG. 2 this is accomplished by having the angle $\alpha$, enlarged to form an angle $\alpha'$. However, the invention is not restricted to a mere enlargement of the widening angle, but can also be in the form of a step. Moreover, the angles $\alpha$ and $\alpha'$, rather than forming an edge, can be joined in a curved manner.

It may be seen from FIG. 2 that the angles $\alpha$ and $\beta$ are measured with respect to a line L that runs parallel to the axis A. Although FIG. 2 shows different magnitudes of those angles $\alpha$ and $\beta$, it should be understood that it is preferred if these tapering angles are mirror symmetrical or complementary with respect to the line L, at least over part of their axial length, i.e., with exception of the section "s" with the angle $\alpha'$ in the embodiment shown.

While the foregoing relates mainly with the peripheral portion 12', it will be understood that impurities such as surface oxides may also cover the front surface thereof facing the opening 15,15'. Although this front surface will ordinarily have a much smaller area than the peripheral surface, the sprue runner 10' can comprise an impurity trap formed as a blind hole 21 which is substantially in alignment with the direction of displacement of the shot plunger 13 along its axis A. The sprue runner of FIG. 2 has then a branch conduit 10" leading upwards and sidewards into the die cavity (not shown). By the blind hole 21, any impurity that may be on the front surface of a slug, while being pushed directly out of the front opening 15', will engage the inner wall of this blind hole and will thus be trapped therein. It should be noted that a squeeze piston 22 may form the back wall of this blind hole 21. Alternatively or cumulatively, cyclone-like traps can be provided along the sprue runner, e.g., along the branch conduit 10".

In order to remove any biscuit out of the shot sleeve at the end of the shot, either the front surface of the plunger 13 can have a suitable configuration such as an undercut to grip the biscuit and to tear it off when the plunger 13 is retracting, or the parts delimiting the front opening 15' can be displaced apart to release the biscuit such as by the sliding plate arrangement disclosed in DE 19507995-A1. Both approaches are well known to those skilled in the art.

Figure 3:
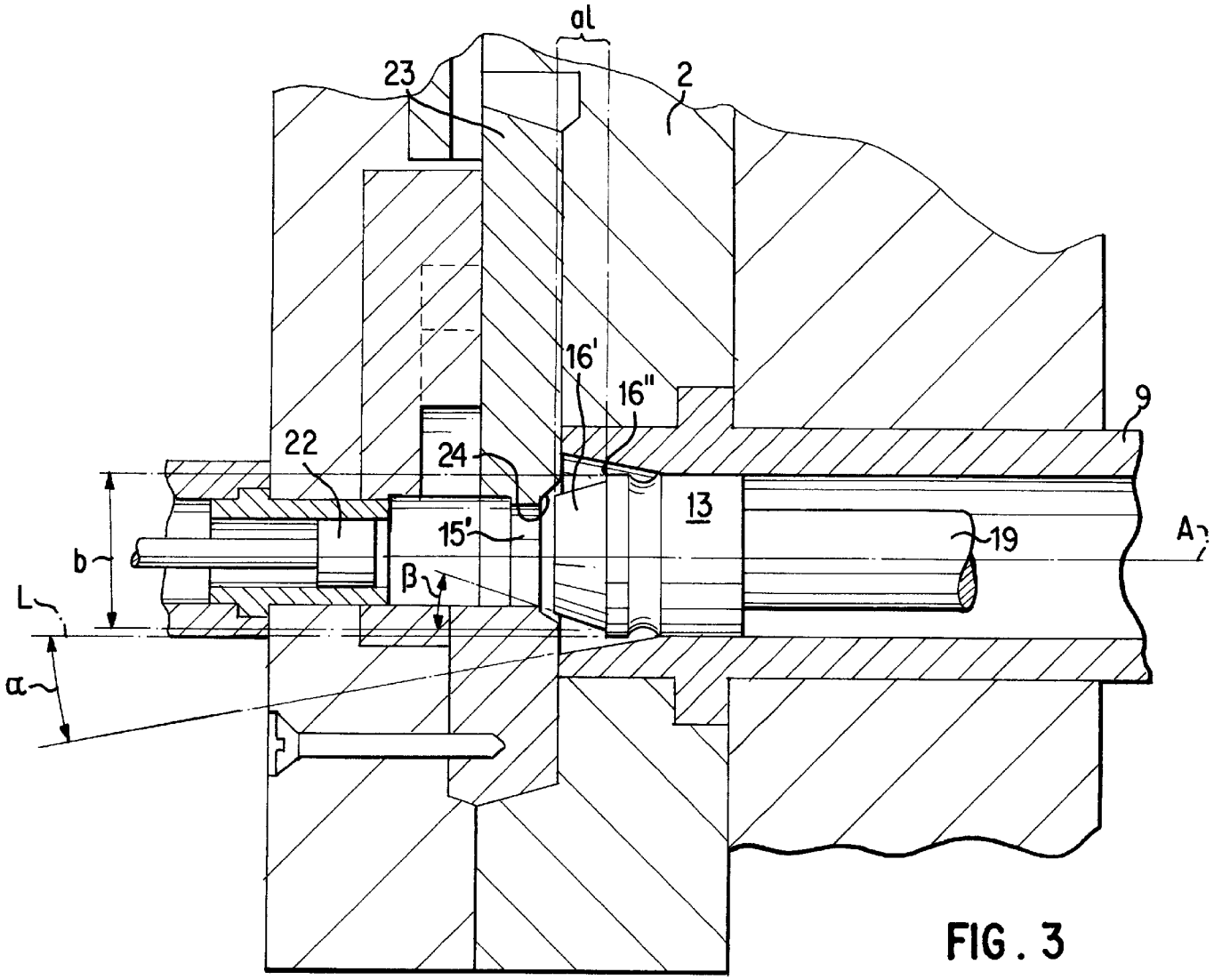

In the embodiment of FIG. 3, the sprue runner system and trap are much the same as shown in FIG. 2. The conical front surface 16' is, in this case larger as compared with that of FIG. 2, i.e., it has an axial length $a\ell$ which is substantially equal to that of the hollow cone formed by the end section of the chamber that is defined by the shot sleeve 9. Since the axial length $a\ell$ shall act in the manner of a plough, it is preferable if the axial length $a\ell$ amounts to at least 50% of its width b measured perpendicularly to the longitudinal axis A. It has been found that it is not critical, if the axial length is about as long as the width b or even longer. It is, however, more preferable, if the axial length $a\ell$ amounts to at least 66% of width b, and in the most preferred case, the axial length $a\ell$ amounts to about 70% to 80% of said width. Furthermore, it can be seen that the angles $\alpha$ and $\beta$ are mirror symmetrical or complementary with respect to line L. To facilitate the manufacture, the axial end surface is flat forming a 90° angle with the axis A.

An important modification of the function of the conical front surface 16' resides in that it acts as a kind of valve body that co-operates with a recess such as a hollow conical surface 24 formed in the piece 23 which defines the front opening 15'. This hollow conical surface 24 faces the chamber of the shot sleeve 9 and forms a predetermined angle with the longitudinal axis A. Preferably this angle corresponds to the angle $\beta$ so that the conical surface 16' can come close to engaging the hollow conical surface 24 when the plunger 13 is in the end position shown in FIG. 3. In this connection, it should be noted that, unless there is a very precise control system which controls the displacement of the plunger 13, an adjustment of the plunger has to be made in such a way that its front surface, in the end position, is spaced by some distance from the surface 24. This distance can serve to exert a certain after-pressure to the metal in the sprue runner, but in the present embodiment this can also be done solely or additionally by squeezing piston 22.

When using a shot sleeve 9 according to the present invention, one can select the length $\ell$ (FIG. 1) in relationship to the axial length of the slug 12 so as to take into account that possible impurities have to be accommodated within the expanded space provided by the enlargement of the chamber 8, on the one hand, and that, in most cases, a biscuit of a certain axial length shall remain (to provide a stock of material for an after-pressure after filling the cavity and before the metal is solidified). Therefore the length $\ell$ of the enlarged portion of the shot sleeve 9 can amount to at east the length of the slug 12 used, but, ordinarily, it will be still more favorable if the length of said enlarged portion of the shot sleeve is sufficient to allow the enlarged portion to accommodate at least twice the volume of the portion of the metal to be retained.

The use of interengaging or mating conical surfaces 16' and 24 reduces the loss of metal due to a biscuit of significant length, on the one hand, and closes the chamber of the shot sleeve 9 so as to adequately prevent entry of impurities from this chamber into the runner system, on the other hand.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A shot sleeve for a die casting machine comprising:

an elongated hollow body for receiving and guiding a shot plunger, said body extending along a longitudinal axis and defining an elongated chamber of predetermined cross-section and width, when measured transversely to said longitudinal axis, and having a front opening to face a sprue runner of a die, said predetermined cross-section enlarging over part of its length towards said front opening;

fastening means on said body for holding the body in fixed relationship with said die; and the body including an elongated opening in a sidewall thereof, the elongated opening having a length parallel to said longitudinal axis and width perpendicular to said longitudinal axis sufficient to receive a slug of semi-solid material sized to die cast one or more parts, the enlargement of said predetermined cross-section being sufficient to accommodate oxides on the slug and prevent the oxides from passing through the front opening during die casting of the one or more parts.

2. The shot sleeve as claimed in claim 1, wherein said predetermined cross-section enlarges monotonously at least over part of its length.

3. The shot sleeve as claimed in claim 2, wherein said chamber includes first and second sections, the second section being between the first section and the front opening, the second section having a cross-section which enlarges to a greater degree than the first section.

4. The shot sleeve as claimed in claim 1, wherein the enlargement of said predetermined cross-section is formed by at least one step in an inner wall of the chamber.

5. A shot sleeve for a die casting machine comprising:

an elongated hollow body for receiving and guiding a shot plunger, said body extending along a longitudinal axis and defining an elongated chamber of predetermined cross-section and width, when measured transversely to said longitudinal axis, and having a front opening to face a sprue runner of a die, said predetermined cross-section enlarging over part of its length towards said front opening;

fastening means on said body for holding the body in fixed relationship with said die; and the enlargement of said predetermined cross-section is formed by at least one step in an inner wall of the chamber, said step having a cross-section which increases 2 to 8% in a direction towards the front opening.

6. A shot unit for a die casting machine comprising:

a shot plunger displaceable along a predetermined path from a shot starting position to an end position, said plunger having a front surface defined by a perimetrical edge, and a rear surface;

drive means for driving said shot plunger along said predetermined path, said drive means including a plunger rod connected to said rear surface;

an elongated hollow shot sleeve for receiving and guiding said shot plunger, said shot sleeve defining an elongated chamber of predetermined cross-section along a longitudinal axis and having a front opening leading to a sprue runner of a die, said predetermined cross-section enlarging over at least part of its length towards said front opening;

fastening means on said sleeve for holding the sleeve in fixed relationship with said die; and the shot sleeve including an elongated opening in a sidewall thereof, the elongated opening having a length parallel to said longitudinal axis and width perpendicular to said longitudinal axis sufficient to receive a slug of semi-solid material sized to die cast one or more parts, the enlargement of said predetermined cross-section being sufficient to accommodate oxides on the slug and prevent the oxides from passing through the front opening during die casting of the one or more parts.

7. The shot unit as claimed in claim 6, wherein said predetermined cross-section enlarges monotonously at least over part of its length.

8. The shot unit as claimed in claim 6, wherein said chamber includes first and second sections, the second section being between the first section and the front opening, the second section having a cross-section which enlarges to a greater degree than the first section.

9. The shot unit as claimed in claim 6, wherein the enlargement of said predetermined cross-section is formed by at least one step in an inner wall of the chamber.

10. A shot unit for a die casting machine comprising:

a shot plunger displaceable along a predetermined path from a shot starting position to an end position, said plunger having a front surface defined by a perimetrical edge, and a rear surface;

drive means for driving said shot plunger along said predetermined path, said drive means including a plunger rod connected to said rear surface;

an elongated hollow shot sleeve for receiving and guiding said shot plunger, said shot sleeve defining an elongated chamber of predetermined cross-section along a longitudinal axis and having a front opening leading to a sprue runner of a die, said predetermined cross-section enlarging over at least part of its length towards said front opening, the enlargement of said predetermined cross-section being formed by at least one step in an inner wall of the chamber; and fastening means on said sleeve for holding the sleeve in fixed relationship with said die;

said step having a cross-section which increases 2 to 8% in a direction towards the front opening.

11. The shot unit as claimed in claim 6, wherein said front surface of said shot plunger comprises a conical surface tapering away from said perimetrical edge at a tapering angle with respect to a line parallel to said longitudinal axis, said conical surface having a cross-section which decreases towards the front opening.

12. The shot unit as claimed in claim 11, wherein the enlarged predetermined cross-section is formed by a second tapering angle with respect to a line parallel to said longitudinal axis, said first and second tapering angles being complimentary at least over part of their axial length.

13. A shot unit for a die casting machine comprising:

a shot plunger displaceable along a predetermined path from a shot starting position to an end position, said plunger having a front surface defined by a perimetrical edge, and a rear surface;

drive means for driving said shot plunger along said predetermined path, said drive means including a plunger rod connected to said rear surface;

an elongated hollow shot sleeve for receiving and guiding said shot plunger, said shot sleeve defining an elongated chamber of predetermined cross-section along a longitudinal axis and having a front opening leading to a sprue runner of a die, said predetermined cross-section enlarging over at least part of its length towards said front opening; and fastening means on said sleeve for holding the sleeve in fixed relationship with said die;

said front surface of said shot plunger comprising a conical surface tapering away from said perimetrical edge at a tapering angle with respect to a line parallel to said longitudinal axis, said conical surface having a cross-section which decreases towards the front opening, at least one of said first and second tapering angles being in a range of 3 to 20° at least over part of its axial length.

14. The shot unit as claimed in claim 13, wherein at least one of said first and second tapering angles is about 10°±5° at least over part of its axial length.

15. A shot unit for a die casting machine comprising:

a shot plunger displaceable along a predetermined path from a shot starting position to an end position, said plunger having a front surface defined by a perimetrical edge, and a rear surface;

drive means for driving said shot plunger along said predetermined path, said drive means including a plunger rod connected to said rear surface;

an elongated hollow shot sleeve for receiving and guiding said shot plunger, said shot sleeve defining an elongated chamber of predetermined cross-section along a longitudinal axis and having a front opening leading to a sprue runner of a die, said predetermined cross-section enlarging over at least part of its length towards said front opening; and fastening means on said sleeve for holding the sleeve in fixed relationship with said die;

said front surface of said shot plunger comprising a conical surface tapering away from said perimetrical edge at a tapering angle with respect to a line parallel to said longitudinal axis, said conical surface having a cross-section which decreases towards the front opening, the axial length of said conical surface and of said enlarged predetermined cross-section being substantially equal.

16. The shot unit as claimed in claim 11, wherein an axial end surface of the plunger forms substantially a right angle to said longitudinal axis.

17. A shot unit for a die casting machine comprising:

a shot plunger displaceable along a predetermined path from a shot starting position to an end position, said plunger having a front surface defined by a perimetrical edge, and a rear surface;

drive means for driving said shot plunger along said predetermined path, said drive means including a plunger rod connected to said rear surface;

an elongated hollow shot sleeve for receiving and guiding said shot plunger, said shot sleeve defining an elongated chamber of predetermined cross-section along a longitudinal axis and having a front opening leading to a sprue runner of a die, said predetermined cross-section enlarging over at least part of its length towards said front opening; and fastening means on said sleeve for holding the sleeve in fixed relationship with said die;

said front surface of said shot plunger comprising a conical surface tapering away from said perimetrical edge under a tapering angle with respect to a line parallel to said longitudinal axis, said conical surface having a base of predetermined width, when measured normal to said longitudinal axis, and an axial length amounting to at least 50% of said width.

18. The shot unit as claimed in claim 17, wherein said axial length amounts to at least 66% of said width.

19. The shot unit as claimed in claim 18, wherein said axial length amounts to about 70% to 80% of said width.

20. A shot unit for a die casting machine comprising:

a shot plunger displaceable along a predetermined path from a shot starting position to an end position, said plunger having a front surface defined by a perimetrical edge, and a rear surface;

drive means for driving said shot plunger along said predetermined path, said drive means including a plunger rod connected to said rear surface;

an elongated hollow shot sleeve for receiving and guiding said shot plunger, said shot sleeve defining an elongated chamber of predetermined cross-section along a longitudinal axis and having a front opening leading to a sprue runner of a die, said predetermined cross-section enlarging over at least part of its length towards said front opening;

fastening means on said sleeve for holding the sleeve in fixed relationship with said die; and an opening defining said sprue runner which extends in the direction of said displacement of the shot plunger.

21. The shot unit as claimed in claim 20, wherein said opening defining said sprue runner extends along said longitudinal axis.

22. The shot unit as claimed in claim 20, wherein said opening defining said sprue runner forms a hollow conical surface facing said chamber and forms a predetermined angle with said longitudinal axis.

23. The shot unit as claimed in claim 22, wherein said front surface of said shot plunger comprises a conical surface tapering away from said perimetrical edge, the conical surface of said front surface and said hollow conical surface tapering at substantially the same angle so as to nearly interengage each other when said plunger reaches its end position.

24. The shot unit as claimed in claim 20, further comprising an impurity trap formed as a blind hole substantially in alignment with the direction of said displacement of the shot plunger.

25. A process for removing impurities contained in a circumferential region of a heated slug in a die casting machine, said process comprising the steps of:

heating a slug of a predetermined length;

placing the heated slug in a shot sleeve for said die casting machine, said shot sleeve including an elongated hollow body for receiving and guiding a shot plunger, said body extending along a longitudinal axis and defining an elongated chamber of predetermined cross-section and width, when measured transversely to said longitudinal axis, and having a front opening facing a sprue runner of a die, said predetermined cross-section enlarging over part of its length towards said front opening a distance at least equal to said predetermined length of said slug;

advancing the plunger in the shot sleeve such that a portion of the slug enters the die and forms a shaped part and another portion of the slug forms a biscuit which remains in the shot sleeve, the biscuit being located in the enlarged portion of the chamber; and removing a shaped part from the die and removing the biscuit from the shot sleeve.

26. The process as claimed in claim 25, wherein said plunger is tapered so as to decrease in cross-section in a direction towards the front opening, the biscuit having a tapered outer periphery formed by the enlarged chamber and a tapered depression therein formed by the plunger.

27. The process as claimed in claim 25, wherein the front opening is surrounded by a conical wall, the plunger includes a tapered end and the biscuit includes first and second oppositely tapered outer surfaces, the first outer surface becoming smaller in diameter in a direction towards the front opening and the second outer surface becoming larger in diameter in the direction towards the front opening.

28. The process as claimed in claim 25, wherein the sprue runner includes an impurity trap comprising a blind hole and a displaceable piston in the blind hole, the process further comprising applying pressure to the piston after the plunger forms the biscuit.

29. The process as claimed in claim 25, wherein the slug comprises a semi-solid material, the shot sleeve including an elongated opening in a sidewall thereof through which the slug is inserted into the shot sleeve, the enlarged portion of said chamber being large enough to accommodate oxides on the slug and prevent the oxides from passing through the front opening when the shaped part is formed.

30. The process as claimed in claim 25, wherein said chamber includes a first portion of circular cross-section engaging a scraping edge of the shot plunger and a second portion of circular cross-section forming the enlarged portion of the chamber, the shot plunger being advanced into the second portion and trapping circumferential oxides on the slug in a space between an outer periphery of the shot plunger and an inner surface of the second portion when the shaped part is formed.

31. The process as claimed in claim 25, wherein said sprue runner includes a first sprue section extending along the longitudinal axis and a second sprue section extending perpendicularly to the longitudinal axis, the first sprue section having a diameter at least 10 percent smaller than the front opening and providing a flow path through which a central portion of the slug passes from the front opening to the second sprue section, the chamber including a first portion of circular cross-section engaging a scraping edge of the shot plunger and a second portion of circular cross-section forming the enlarged portion of the chamber, the shot plunger being advanced into the second portion and trapping circumferential oxides on the slug in a space between an outer periphery of the shot plunger and an inner surface of the second portion when the shaped part is formed.

32. A shot unit for a die casting machine comprising:

a shot plunger displaceable along a predetermined path from a shot starting position to an end position, said plunger having a front surface defined by a perimetrical edge, and a rear surface;

drive means for driving said shot plunger along said predetermined path, said drive means including a plunger rod connected to said rear surface;

an elongated hollow shot sleeve for receiving and guiding said shot plunger, said shot sleeve defining an elongated chamber of predetermined cross-section along a longitudinal axis and having a front opening leading to a sprue runner of a die, said predetermined cross-section enlarging over at least part of its length towards said front opening; and fastening means on said sleeve for holding the sleeve in fixed relationship with said die; the fastening means comprising a flange on an outer periphery of said shot sleeve, the enlargement of said predetermined cross-section being between said front opening and said flange.

33. A shot sleeve for a die casting machine comprising:

an elongated hollow body for receiving and guiding a shot plunger, said body extending along a longitudinal axis and defining an elongated chamber of predetermined cross-section and width, when measured transversely to said longitudinal axis, and having a front opening to face a sprue runner of a die, said predetermined cross-section enlarging over part of its length towards said front opening;

fastening means on said body for holding the body in fixed relationship with said die; and said chamber including a first portion of circular cross-section engaging a scraping edge of the shot plunger and a second portion of circular cross-section, the second portion having a diameter larger than the first portion and the second portion extending a distance along said longitudinal axis greater than the diameter of the first portion.

34. A shot unit for a die casting machine comprising:

a shot plunger displaceable along a predetermined path from a shot starting position to an end position, said plunger having a front surface defined by a perimetrical edge, and a rear surface;

drive means for driving said shot plunger along said predetermined path, said drive means including a plunger rod connected to said rear surface;

an elongated hollow shot sleeve for receiving and guiding said shot plunger, said shot sleeve defining an elongated chamber of predetermined cross-section along a longitudinal axis and having a front opening leading to a sprue runner of a die, said predetermined cross-section enlarging over at least part of its length towards said front opening; and fastening means on said sleeve for holding the sleeve in fixed relationship with said die, said chamber including a first portion of circular cross-section engaging a scraping edge of the shot plunger and a second portion of circular cross-section, the second portion having a diameter larger than the first portion and the second portion extending a distance along said longitudinal axis greater than the diameter of the first portion.

35. A shot unit for a die casting machine comprising:

a shot plunger displaceable along a predetermined path from a shot starting position to an end position, said plunger having a front surface defined by a perimetrical edge, and a rear surface;

drive means for driving said shot plunger along said predetermined path, said drive means including a plunger rod connected to said rear surface;

an elongated hollow shot sleeve for receiving and guiding said shot plunger, said shot sleeve defining an elongated chamber of predetermined cross-section along a longitudinal axis and having a front opening leading to a sprue runner of a die, said predetermined cross-section enlarging over at least part of its length towards said front opening; and fastening means on said sleeve for holding the sleeve in fixed relationship with said die;

the sprue runner extending perpendicularly to the longitudinal axis, at least a portion of the sprue runner being defined by part of an axial end face of the shot sleeve.

36. A shot sleeve for a die casting machine comprising:

an elongated hollow body for receiving and guiding a shot plunger, said body extending along a longitudinal axis and defining an elongated chamber of predetermined cross-section and width, when measured transversely to said longitudinal axis, and having a front opening to face a sprue runner of a die, said predetermined cross-section enlarging over part of its length towards said front opening; and fastening means on said body for holding the body in fixed relationship with said die, the fastening means comprising a flange on an outer periphery of said body, the enlargement of said predetermined cross-section being between said front opening and said flange.

* * * * *